US007005839B2

(12) United States Patent
Wada

(10) Patent No.: US 7,005,839 B2
(45) Date of Patent: Feb. 28, 2006

(54) REFERENCE POWER SUPPLY CIRCUIT FOR SEMICONDUCTOR DEVICE

(75) Inventor: Masaharu Wada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/803,934

(22) Filed: Mar. 19, 2004

(65) Prior Publication Data

US 2005/0127889 A1 Jun. 16, 2005

(30) Foreign Application Priority Data

Dec. 10, 2003 (JP) ..... 2003-411919

(51) Int. Cl.
*G05F 3/16* (2006.01)

(52) U.S. Cl. ..... 323/316; 323/313

(58) Field of Classification Search ..... 323/304, 323/311, 313–316
See application file for complete search history.

(56) References Cited

U.S. PATENT DOCUMENTS 6,052,020 A * 4/2000 Doyle ..... 327/539
6,133,719 A * 10/2000 Maulik ..... 323/313
6,683,445 B1 * 1/2004 Park ..... 323/315

FOREIGN PATENT DOCUMENTS

JP 11-45125 2/1999

* cited by examiner

*Primary Examiner*—Gary L Laxton

(74) *Attorney, Agent, or Firm*—Oblon, Spivak, McClelland, Maier & Neustadt, P.C.

(57) ABSTRACT

A first PN junction and first current supply are connected between a first potential and a second potential. A second PN junction, first resistive element and second current supply are connected between the first potential and the second potential, the size of the second PN junction being different from that of the first PN junction. A second resistive element is connected in parallel with the first resistive element and second PN junction. A differential amplifier is configured to receive, at an inverting input terminal, a potential between a first current supply and the first PN junction and, at a non-inverting input terminal, a potential on a connection point between a second current supply and the first resistor and to control the first, second and third current supplies by a potential difference between the inverting input and the non-inverting input.

21 Claims, 9 Drawing Sheets

REFERENCE POWER SUPPLY CIRCUIT FOR SEMICONDUCTOR DEVICE

CROSS-REFERENCE TO RELATED APPLICATIONS

This application is based upon and claims the benefit of priority from the prior Japanese Patent Application No. 2003-411919, filed Dec. 10, 2003, the entire contents of which are incorporated herein by reference.

BACKGROUND OF THE INVENTION

1. Field of the Invention

The present invention relates to a reference power supply circuit applied to, for example, a semiconductor device and configured to generate a reference current and reference voltage.

2. Description of the Related Art

A semiconductor device has a reference power supply circuit for generating a reference current and reference voltage. The reference power supply circuit is so configured as to include, for example, a BGR (Band Gap Reference) circuit. In recent years, a power supply of the semiconductor device has been made to have a low voltage and a semiconductor device has been developed which can operate even at a low power supply voltage of below 1.25V (see Japanese Patent Laid Open (KOKAI) No. 11-45125).

FIG. 17 shows one practical form of a conventional reference voltage generation circuit. In FIG. 17, an output voltage PGT of a differential amplify circuit AMP is supplied to the gates of P channel MOS transistors (hereinafter referred to as PMOS transistors P1, P2). This differential amplifier AMP controls the PMOS transistor P1 and P2 so as to make potentials on connection nodes INP and INN equal to each other. At this time, with IA representing a current flowing through a resistor RA; VA, a potential difference across a diode D2; and VA', a potential difference across resistors RB, RB, the following equation (1) is established:

$$VA'=RA\cdot IA+VA \tag{1}$$

The current and voltage of the diode are given below.

$$I=I_s\cdot\exp(q\ V/kT) \tag{2}$$

$$V=V_0\cdot\ln(I/I_s),\ (V_0=kT/q) \tag{3}$$

, noting that $I_s$: reverse saturation current; k: Boltzmman constant; T: absolute temperature; and q: electron charge.

If the equation (1) is modified with the use of the equation (3), then the temperature characteristic of the current IA is represented as follows:

$$IA=V_0/RA\cdot\ln(I_{SA}/I_{SB}) \tag{4}$$

Here, $I_{SA}$, $I_{SB}$ represent the reverse saturation currents of the diodes D2, D1. From the equation (4) the temperature characteristic of the current IA becomes $$dIA/dT=k/(RA\cdot q)\cdot\ln I_{SA}/I_{SB}>0 \tag{5}$$

as shown in equation (5).

Further, the relation between the resistance PB, current IB on one hand and the potential difference VA' across the resistor RB on the other becomes $$VA'=RB\cdot IB$$

$$IB=VA'/RB \tag{6}$$

as shown in the equation (6).

From the equation (6), the temperature characteristic of the current IB flowing through the resistor RB becomes $$dIB/dT=1/RB\cdot dVA'/dT<0 \tag{7}$$

If, at this time, the circuit condition is selected under which the variations of the IA and IB with respect to the temperature cancel each other by their sum as shown in the equation (8) below, then a current supply of a smaller temperature dependence is provided.

$$(dIA/dT)+(dIB/dT)=0 \tag{8}$$

For example, if the size ratio of the diodes D2, D1 is given by 100:1, then the resistance ratio RB:RA is found as follows:

$$RB/RA=(q/k\cdot dVA'/dT)/\ln(I_{SA}/I_{SB})$$

Here, the numerical value of each parameter is given below.

$$q=1.6e^{-19}\ (C),\ k=1.38e^{-23}\ (J/K)$$

$$dVA'/dT=-2\ (mV),\ \ln(I_{SA}/I_{SB})=\ln(100)\approx 4.6$$

Therefore, the resistance ratio RB/RA becomes $$RB/RA\approx 23/4.6=5 \tag{9}$$

From the equation (9), the resistance ratio RB:RA becomes equal to about 5:1.

If the circuit shown in FIG. 17 is configured with the use of the size ratio of the diodes and resistance ratio above, then the PMOS transistors P1, P2, P3 function as a current supply of a smaller temperature dependence. By connecting a required resistor RC between the PMOS transistor P3 and ground, it is possible to provide an output voltage VREF of a smaller temperature dependence.

By the mismatching (variation) of a transistor pair (not shown) constituting an input stage of the differential amplifier AMP, that of a mirror connected PMOS transistors P1, P2, P3 and that of the characteristics of the diodes and resistors, the output voltage VREF also varies.

Incidentally, in order to make a variation of the above-mentioned output voltage VREF smaller, a method for increasing the size of the resistors RA, RB, diodes D1, D2, transistors P1, P2, P3, etc., and, by doing so, decreasing the variation of each element is taken. Since this method increases the size of the respective elements, a whole circuit size is increased as a first problem and a high manufacturing cost is involved. In particular, the size of the whole circuit is defined by the size of the diode D1 and resistor RB and it is necessary to reduce the size of these.

Further, if the size of the transistor pair constituting an input stage of the differential amplifier AMP is made greater, a parasitic capacitance of a negative feedback circuit is increased and the phase margin is decreased. This poses a second problem of lowering a stability of the circuit involved.

FIG. 18 shows the voltage/current characteristic of the circuit shown in FIG. 17. In FIG. 18, the curve CA' shows the voltage/current characteristic of a circuit constituting a parallel array of a series-connected resistor RA and diode 2 on one hand and a resistor RB on the other, while the current/voltage characteristic CB' shows a current/voltage characteristic of a parallel connection array of the diode D1 and resistor RB.

FIGS. 4B and 5B each show an enlarged view of a crosspoint of the two curves CA', CB'. In the case where the transistor pair constituting an input stage of the differential amplifier AMP has a variation of a threshold voltage, the curves CA', CB' are equivalent to the shifted states as indicated by broken lines CA1', CA2', CB1', CB2' in FIGS. 4B and 5B. At this time, the current values of the PMOS transistors P1, P2 and P3 are shifted to the characteristics of broken lines CIA1', CIA2', CIB1', CIB2' with respect to an original current value CI'. At this time, the smaller the crossing angle between the curves CA' and CB', the greater the variation of an output current value.

In particular, by connecting the resistor in parallel with the diode, the crossing angle between both the curves becomes smaller. As a third problem, this circuit involves a greater variation in output voltage or output current than a circuit not using a parallel connection array of the resistor and diode.

Further, the differential amplifier AMP is generally of a type that an input voltage is applied to the gate of the NMOS transistor pair. In such a differential amplifier, if the temperature rises and the forward voltage of the diode becomes smaller, a source potential on an NMOS transistor pair is lowered and a drain potential on a current controlling NMOS transistor (for example, N3 in FIG. 15) becomes deficient. As a result, if use is made of a differential amplifier of a type that an input voltage is applied to the NMOS transistor pair, there is a risk, as a fourth problem, that a circuit involved will cease to operate under a high temperature condition.

Further, a current additive type reference voltage generation circuit as shown in FIG. 19 has also been developed. Even this circuit involves a similar problem as in the case of the circuit shown in FIG. 17. Further, more circuit elements are required, presenting a problem. There has been an increasing demand that a reference power supply circuit of a compact size be developed which involves less variation in output voltage or output current and ensures a stabler operation.

BRIEF SUMMARY OF THE INVENTION

According to a first aspect of the present invention there is provided a reference power supply circuit comprising: a first PN junction configured to connect an N type semiconductor area to a first potential; a second PN junction configured to connect an N type semiconductor area to the first potential and having a size different from that of the first PN junction; a first current supply connected between a second potential and a P type semiconductor area of the first PN junction; a first resistive element having one end connected to a P type semiconductor area of the second PN junction; a second resistive element configured to be connected in parallel with the first resistive element and second PN junction; a second current supply configured to be inserted between the other end of the first resistive element and the second potential; a third current supply configured to be connected between the second potential and an output terminal; and a differential amplifier having an inverting input terminal and a non-inverting input terminal and configured to receive, at the inverting input terminal, a potential on a first connection point between the first current supply and the first PN junction and, at the non-inverting input terminal, a potential on a second connection point between the second current supply and the first resistive element and control the first, second and third power supplies by a difference between a potential of the inverting input terminal and a potential of the non-inverting input terminal.

According to a second aspect of the invention, there is provided a reference power supply circuit comprising a first diode having a cathode connected to a first potential; a second diode having a cathode connected to the first potential and having a size different from that of the first diode; a first transistor of a first conductivity type configured to be connected between a second potential and the anode of the first diode and constitute a current supply; a first resistive element having one end connected to the anode of the second diode; a second resistive element connected in parallel with the first resistive element and second diode; a second transistor of a first conductivity type configured to be inserted between the other end of the first resistive element and the second potential and constitute a current supply; a third transistor of a first conductivity type configured to be connected between the second potential and an output terminal and constitute a current supply; and a differential amplifier having an inverting input terminal and a non-inverting input terminal and configured to receive, at the inverting input terminal, a potential on a first connection point between the first transistor and the first diode and, at the non-inverting input terminal, a potential on a second connection point between the second transistor and the first resistive element, the differential amplifier being configured to control the first, second and third transistors by a difference between a potential the inverting input terminal and a potential of the non-inverting input terminal.

According to a third aspect of the present invention, there is provided a reference power supply circuit comprising: a first PN junction configured to connect an N type semiconductor area to a first potential; a second PN junction configured to connect an N type semiconductor area to the first potential and having a size different from that of the first PN junction; a first resistive element having one end connected to a P type semiconductor area of the second PN junction; a second resistive element configured to be connected in parallel with the first resistive element and second PN junction; a current supply connected between a second potential and an output terminal; and a mirror circuit configured to allow a current which flows through the first PN junction to be copied to a corresponding current through the first and second resistive elements and second PN junction and control the current supply in accordance with the current flowing through the first and second resistive elements and second PN junction.

DETAILED DESCRIPTION OF THE INVENTION

Figure 1:
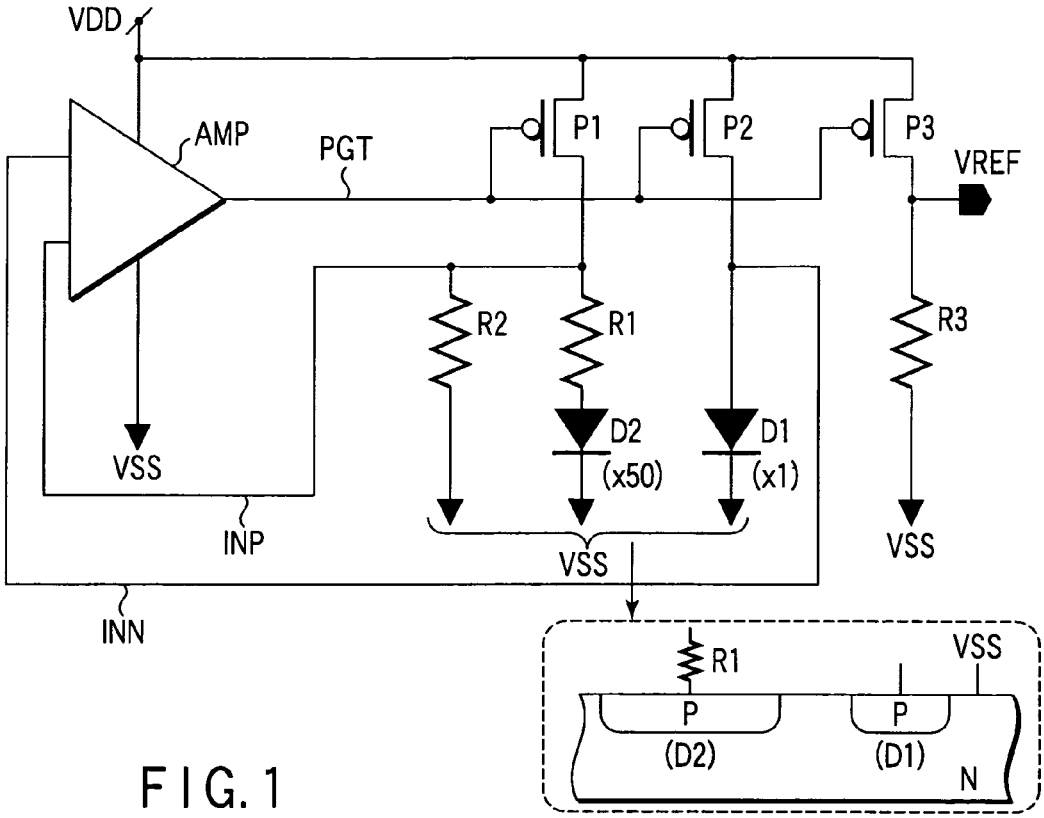
FIG. 1 shows a first embodiment, that is, a practical form of a reference voltage generation circuit.

The embodiments of the present invention will be described below with reference to the accompanying drawing. Identical reference numerals are employed to designate parts or elements corresponding to those shown in respective views.

FIG. 1 shows a first embodiment, that is, a practical form of a reference voltage generation circuit. In FIG. 1, a diode D1 and PMOS transistor P2 having a PN junction are connected, as a series-connected array, between a ground node (VSS node) supplied with a ground potential VSS (first potential) and a power supply node (VDD node) supplied with a power supply potential VDD (second potential). Further, a diode D2 having a PN junction, a resistor R1 and a PMOS transistor P1 are series-connected between the VSS node and the VDD node. A resistor R3 and PMOS transistor P3 are series-connected between the VSS node and the VDD node. A resistor R2 is connected between the VSS node and a connection node which is connected between the resistor R1 and the PMOS transistor P1. A connection node INP between the resistor R1 and the PMOS transistor P1 is connected to a non-inverting input terminal of the differential amplifier AMP while, on the other hand, a connection node INN between the diode D1 and the PMOS transistor P2 is connected to an inverting input terminal of the differential amplifier AMP. An output terminal PGT of the differential amplifier AMP is connected to the gates of the PMOS transistors P1, P2 and P3. A connection node between the PMOS transistor P3 and the resistor R3 constitutes an output node where a reference voltage VREF is outputted. Here, the second power supply potential VDD is set to, for example, 1.0V while the reference voltage VREF can be freely set in a range from 0 to VDD-$V_{dsp}$ in accordance with a resistive value of the resistor R3. Here, $V_{dsp}$ constitutes a drain/source voltage of the PMOS transistor P3.

Figure 2:
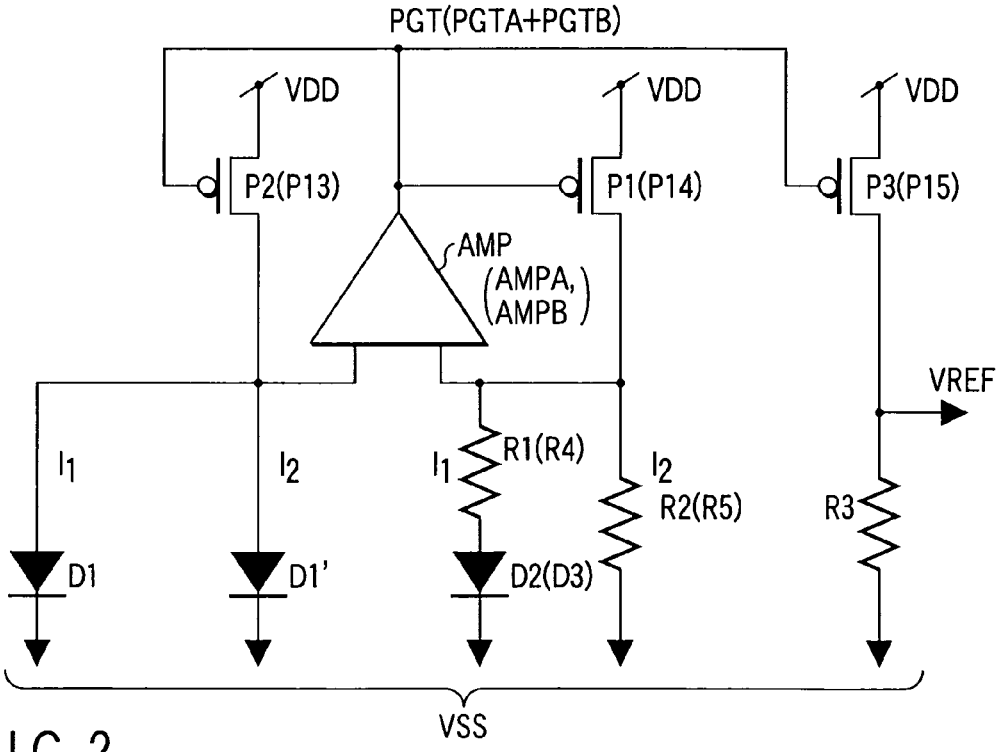
FIG. 2 is a circuit diagram for explaining a principle of the first embodiment.
Figure 19:
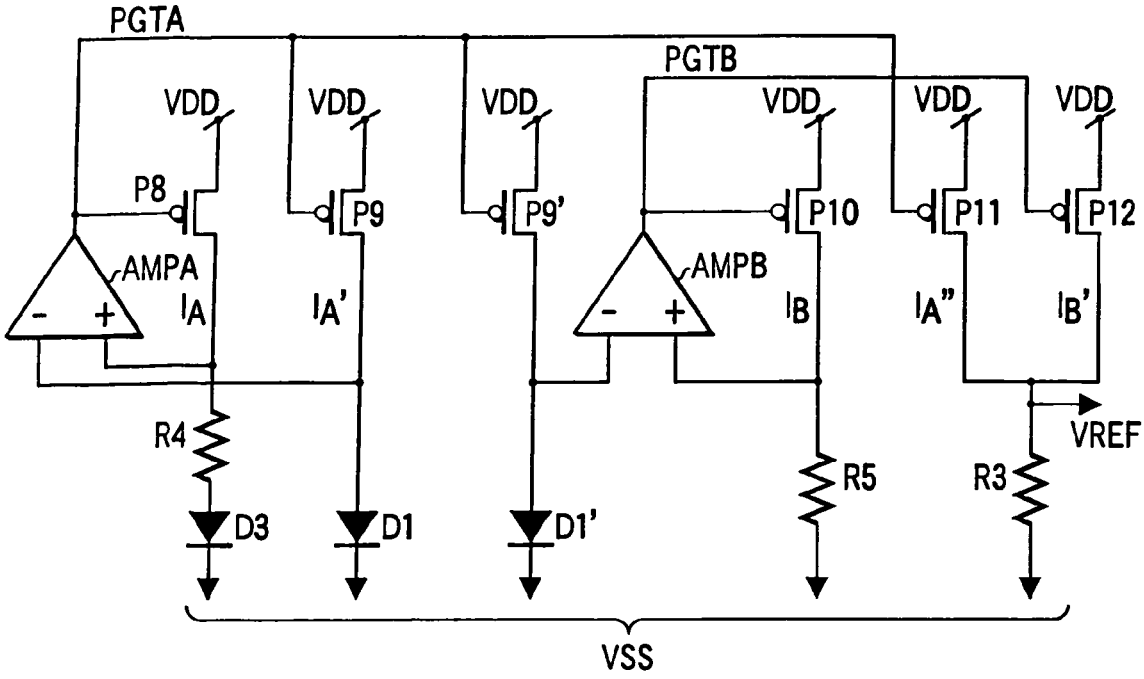
FIG. 19 PRIOR ART
FIG. 19 is a circuit diagram showing another example of a conventional reference voltage circuit.

FIG. 2 is a view for explaining a principle on the first embodiment. FIG. 2 shows an overlay circuit on which an overlay is done between differential amplifiers AMPA and AMPB, diodes D1 and D1', a parallel circuit of a resistor R4 and diode D3 and a resistor R5, PMOS transistors P9 and P9', P8 and P10, and P11 and P12 shown in FIG. 19.

In FIG. 2, identical reference numerals are employed to designate parts or elements corresponding to those shown in FIG. 1. Here, the diodes D1, D1' and D2 have a size relation of, for example, D2=nD1, D1'=mD1. In the circuit arrangement, a current I1 flows through the diodes D1 and D2 and a current I2 flows through the diode D1' and resistor R2.

Given that a potential difference across the diode D1 is represented by V, the current/voltage characteristic of the diode D1 is represented by the equations (11) and (12).

$$I1=I_s\cdot\exp(pV/kT) \tag{11}$$

$$V=(kT/q)\cdot\ln(I1/I_s) \tag{12}$$

A voltage V across an array of a resistor R1 and diode D2 is given by:

$$V=R1\cdot I1+kT/q\cdot\ln(I1/(n\cdot I_s)) \tag{13}$$

Since the voltages V from the equations (12) and (13) are equal to each other, $$R1\cdot I1+(kT/q)\cdot\ln(I1/(n\cdot I_s))=(kT/q)\cdot\ln(I1/I_s) \tag{14}$$

$$R1\cdot I1=(kT/q)\cdot\ln(n\cdot I_s/I_s) \tag{15}$$

$$I1=(kT/(q\cdot R1))\cdot\ln(n\cdot I_s/I_s) \tag{16}$$

Since the size of the diode D1' is m times that of the diode D1, a current flowing through the diode D1' is m·I1. Since the same current I2 flows through the diode D1' and resistor R2, $$R2\cdot m\cdot I1=V \tag{17}$$

$$I1=V/(R2\cdot m) \tag{18}$$

$$I2=m\cdot I1 \tag{19}$$

Since the currents through the PMOS transistors P2 and P1 are given by I1+I2, an equation (20) is established from the equations (16) and (19).

$$I1+I2=(kT/qR1)\ln(n\cdot I_s/I_s)+m\cdot I1 \tag{20}$$

$$I1+I2=(kT/qR1)\ln(n\cdot I_s/I_s)+V/R2 \tag{21}$$

If the equation (21) is differentiated with respect to the temperature, the right side of the equation (21) becomes $$(k/(q\cdot R1))\cdot\ln(n)+(dV/dT)/R2 \tag{22}$$

Here, the temperature characteristic of the PN junction, (dV/dT), is negative. For this reason, by a combination of n, R1, R2 under which the equation (22) becomes a zero, the temperature characteristics of I1+I2 cease to exist. That is, $$(k/(q\cdot R1))\cdot\ln(n)+(dV/dT)/R2=0 \tag{23}$$

$$R2\cdot\ln(n)/R1=-(dV/dT)\cdot q/k \tag{24}$$

The (dV/dT) in the equation (24) represents the temperature characteristic of the diodes D1+D1'.

Further, the diodes D1 and D1' can be regarded as the diode D1 of (1+m). Here, even under m=1, the equation (24) is established. At this time, the arrangement of FIG. 2 can be modified to that of FIG. 1 with the two diodes regarded as one diode.

According to the first embodiment, if, in the circuit shown in FIG. 1, the size ratio of the diodes D1, D2 is held, there is no variation in the temperature characteristics. By doing so, in this circuit, the size of the diodes D1 and D2 can be constituted with one half size of those shown in FIG. 17. In the circuit shown, for example, in FIG. 17, if the size ratio of the diodes D1 and D2 is 1:100, then it is possible to set the size ratio of the diodes D1 and D2 to be 1:about 50.

Figure 17:
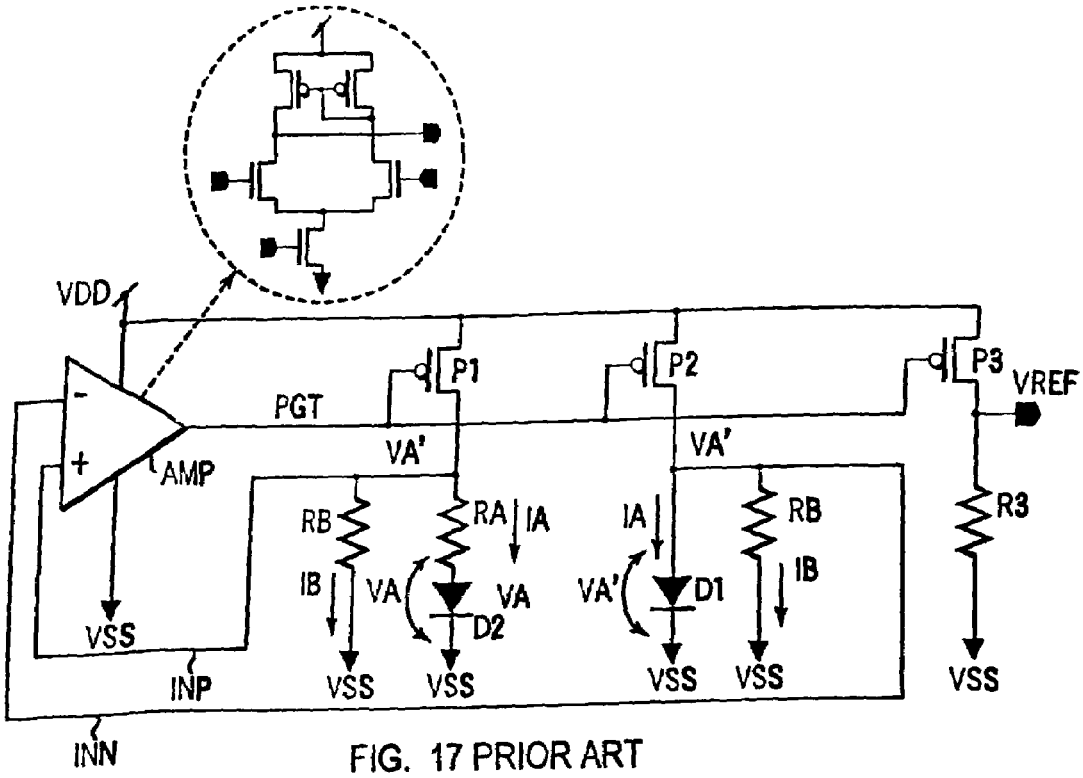
FIG. 17 PRIOR ART
FIG. 17 shows a circuit diagram showing an example of a conventional reference voltage generation circuit.

Further, the circuit shown in FIG. 1 allows the deletion of one of the two resistors RB shown in FIG. 17. Therefore, the size of the resistor can be substantially halved.

Figure 3:
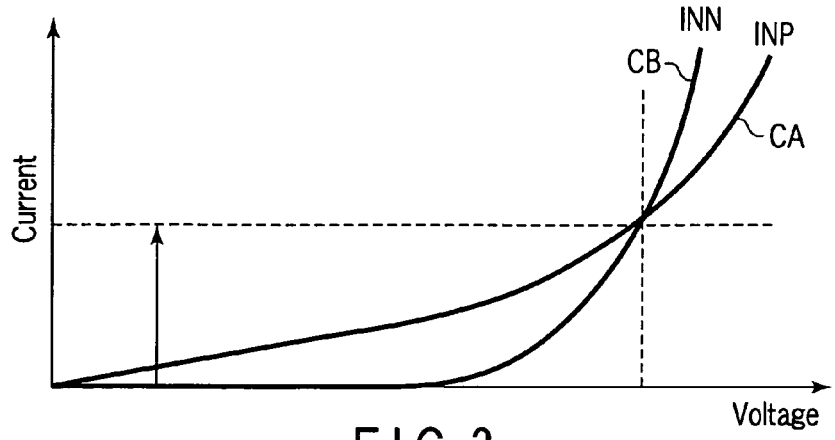
FIG. 3 is a view showing a voltage/current characteristic of the circuit of FIG. 1.
Figure 4A:
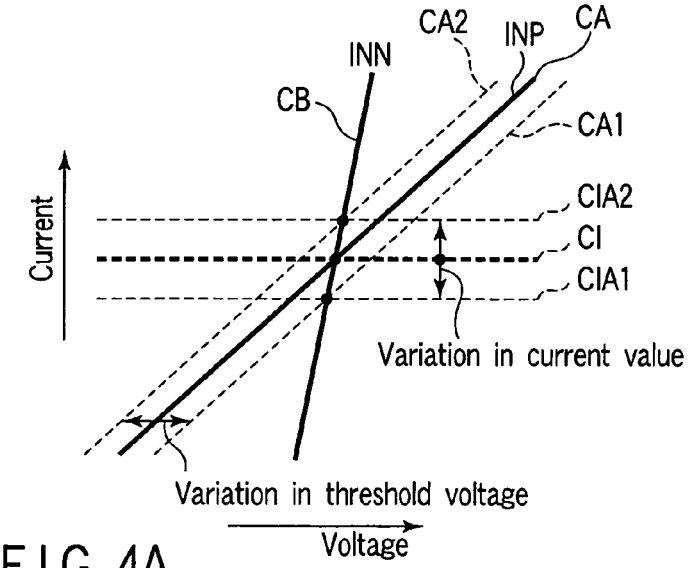
FIGS. 4A and 4B are views showing a voltage/current characteristic on an enlarged form.
Figure 4B:
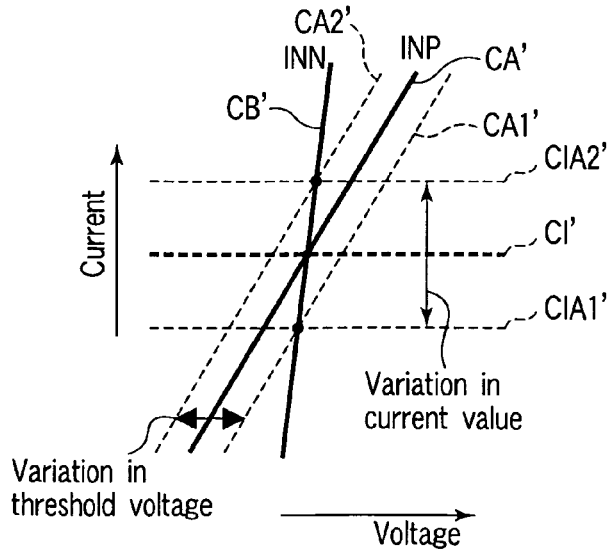
FIG. 4B PRIOR ART
Figure 5A:
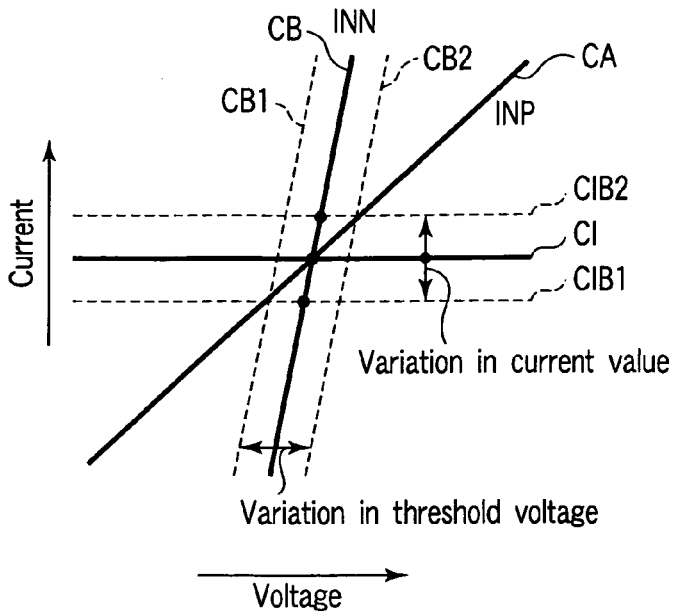
FIGS. 5A and 5B are views showing a voltage/current characteristic on an enlarged form.
Figure 5B:
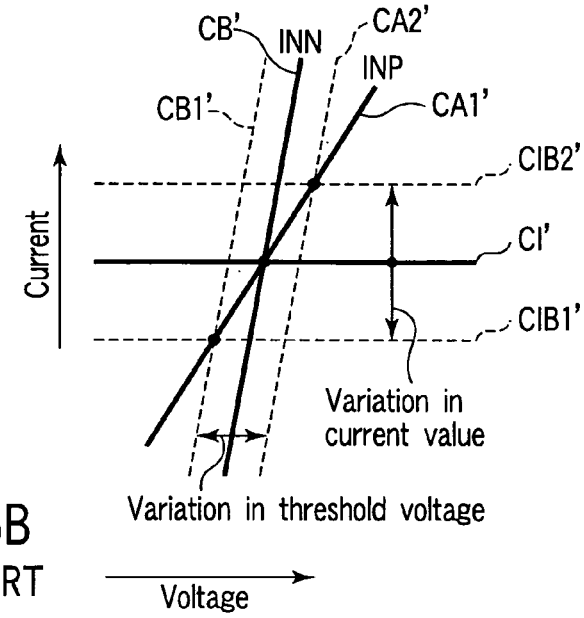
FIG. 5B PRIOR ART
Figure 18:
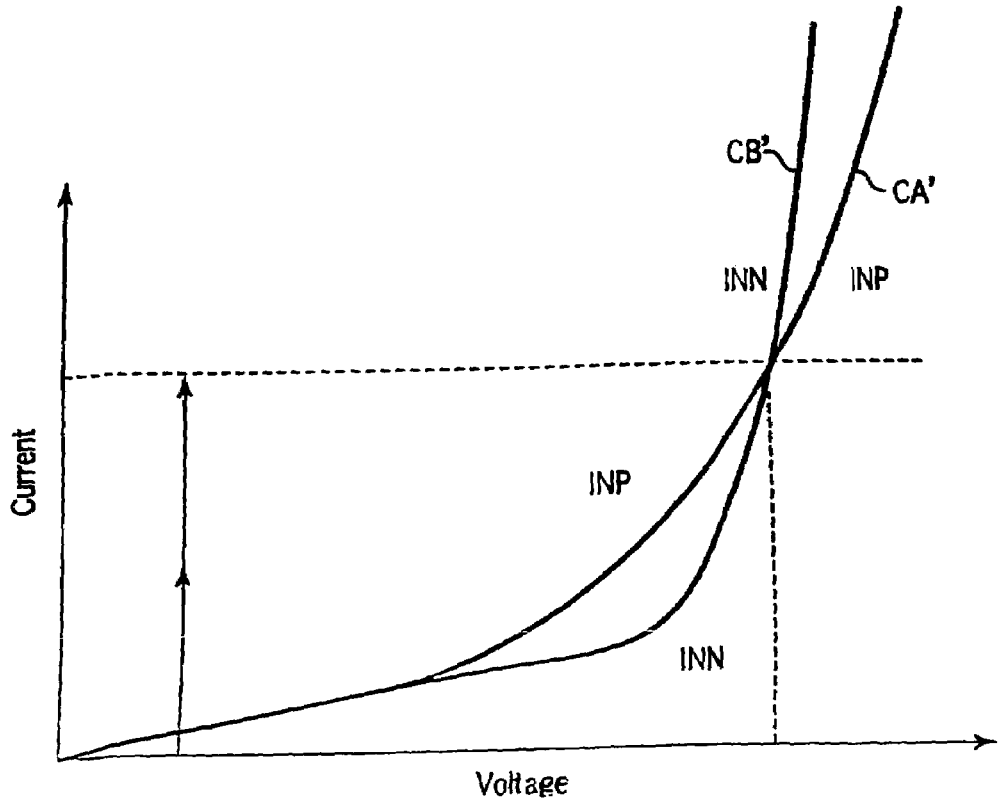
FIG. 18 PRIOR ART
FIG. 18 shows a current/voltage characteristic of FIG. 17.

FIG. 3 shows the voltage/current characteristic of the connection nodes INN and INP shown in FIG. 1. If, as shown in FIG. 1, a resistor to be parallel-connected to the diode D1 is eliminated, the operation curves CA, CB of the connection nodes INP and INN are such that the crossing angle made at a crosspoint as shown in FIG. 3 becomes greater than that in the case of operation curves CA', CB' of the conventional circuit shown in FIG. 18. As shown in FIGS. 4A, 5A, therefore, even if there occurs a variation in a threshold voltage of the NMOS transistor in an input stage of the differential amplifier AMP, it is possible to make, smaller, errors CIA1, CIA2, CIB1, CIB2 of output current CI of the PMOS transistors P1, P2, P3 controlled by an output voltage of the differential amplifier AMP. It is, therefore, possible to generate a stable reference voltage VREF.

(Second Embodiment)

Figure 6:
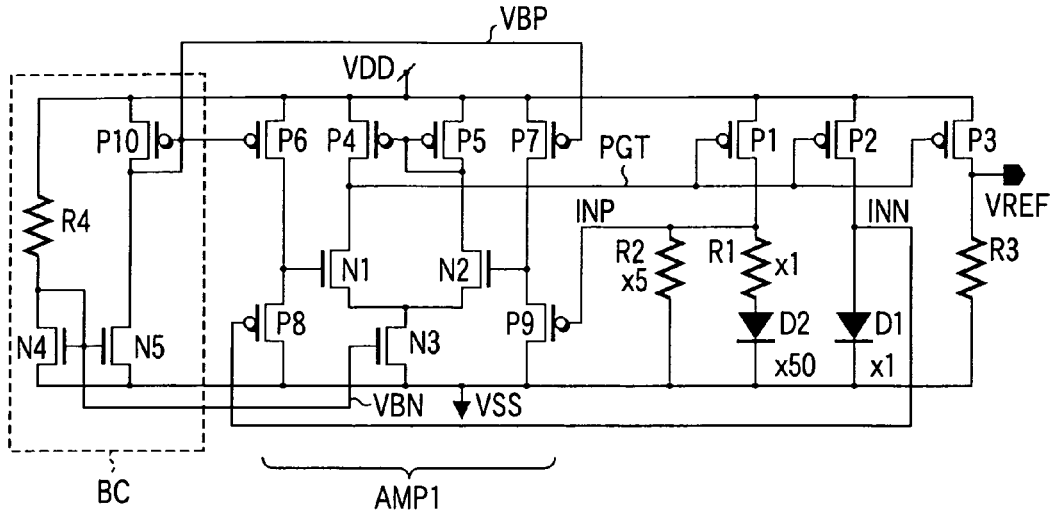
FIG. 6 shows a second embodiment, that is, practical form of a reference voltage generation circuit.

FIG. 6 shows a second embodiment, that is, a practical form of a reference voltage generation circuit. The second embodiment differs from the first embodiment in the following respects. A differential amplifier AMP1 is comprised of a source follower type differential amplifier. The differential amplifier AMP1 is controlled by a bias voltage VBN which is outputted from a bias circuit BC.

That is, the bias circuit BC comprises a resistor R4, NMOS transistors N4, N5 and PMOS transistor P10. The resistor R4 has one end connected to a VDD node and the other end connected to the drain and gate of the NMOS transistor N4 and to the gate of the NMOS transistor N5. The sources of the NMOS transistors N4 and N5 are connected to a VSS node. Further, the drain of the NMOS transistor N5 is connected to the drain and gate of the PMOS transistor P10 and the source of the PMOS transistor P10 is connected to the VDD node. The magnitude of a bias current which is outputted from the bias circuit BC is set by a resistive value of the resistor R4.

Further, the differential amplifier AMP1 comprises NMOS-transistors N1, N2 and N3 and PMOS transistors P4, P5, P6, P7, P8 and P9. The sources of the PMOS transistors P4 and P5 are connected to the VDD node. The gates of these transistors P4 and P5 are commonly connected to each other and are connected to the drain of the PMOS transistor P5. The drains of the PMOS transistors P4 and P5 are connected to the drains of the NMOS transistors N1 and N2 in the differential pair. The sources of the NMOS transistors N1 and N2 are connected to the drain of the NMOS transistor N3 and the source of the transistor N3 is connected to the VSS node. The gate of the NMOS transistor N3 is connected to the gates of the NMOS transistors N4 and N5 which act as an output terminal of the bias circuit BC. That is, the NMOS transistor N3 is controlled by the output voltage VBN of the bias circuit BC.

The gates of the NMOS transistors N1 and N2 are connected to the drains of PMOS transistors P6 and P7, respectively. The sources of the PMOS transistors P6 and P7 are connected to the VDD node. The gates of the PMOS transistors P6 and P7 are connected to the gate of the PMOS transistor P10 in the bias circuit BC. Therefore, these PMOS transistors P6 and P7 are controlled by an output voltage VBP of the bias circuit BC. Further, the drains of the PMOS transistors P6 and P7 are connected to the sources of the PMOS transistors P8 and P9, respectively.

Further, the gates of the NMOS transistors N1, N2 are connected to the sources of the PMOS transistors P8 and P9. The drains of the PMOS transistors P8 and P9 are connected to the VSS node. The gate of the PMOS transistor P8 is connected to a connection node INN and the gate of the PMOS transistor P9 is connected to a connection node INP. The potentials on the connection nodes INN and INP are connected through the PMOS transistors P8 and P9 to the NMOS transistors N1 and N2, respectively, these PMOS transistors acting as a source follower circuit.

In this circuit arrangement, the PMOS transistors P4 and P5 which are connected to the NMOS transistors N1 and N2 in the differential amplifier AMP1 is conducive to an amplification action. Therefore, a variation in the characteristics of the PMOS transistors P4 and P5 exerts a greater influence on an output. In order to make such a variation smaller, the sizes of the PMOS transistors P4 and P5 are made greater. Further, the PMOS transistors P8 and P9, constituting a source follower, are less conducive to a voltage amplification and can be made smaller in size. In more detail, the sizes of the PMOS transistors P8 and P9 are made about 1/10 the size of the NMOS transistors N1 and N2 constituting a differential pair. By, in this way, making the sizes of the PMOS transistors P8 and P9 smaller than normal PMOS transistors and NMOS transistors, it is possible to decrease the parasitic capacitance of the feedback circuit and, hence, to ensure a greater phase margin.

Figure 7:
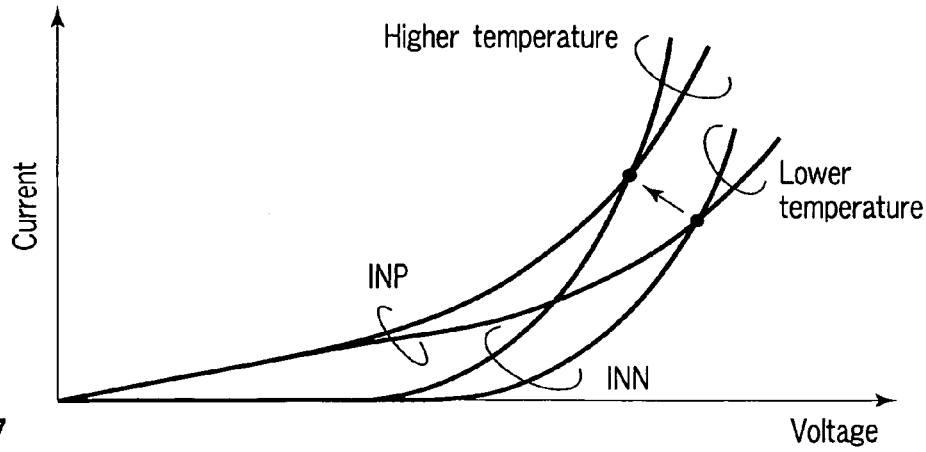
FIG. 7 is a view showing a voltage/current characteristic of a second embodiment.

FIG. 7 shows the temperature characteristics of the operation curves of the connection nodes INP and INN in the second embodiment. It is evident from FIG. 7 that, with a rise in temperature, the potentials on the crosspoints of the operation curves of the connection nodes INP and INN become lower. In a differential amplifier including an NMOS transistor having its gate supplied with an input voltage, as shown in FIG. 17, the operation margin decreases, if at a higher temperature, the forward voltages of diodes D1, D2 become smaller. In the circuit arrangement shown in FIG. 6, however, potentials on the connection nodes INN and INP are applied to the gates of the PMOS transistors P8 and P9 acting as the source follower circuit and it is, therefore, possible to positively operate the differential amplifier even at a higher temperature and secure an operation margin.

According to the second embodiment, the PMOS transistors P8 and P9 are placed, as a source follower circuit, in the input stages of the differential amplifier AMP1 and configured to receive input signals. In general, under a high temperature condition, the forward currents of the PN junctions of the diodes D1, D2 become greater and, as a result, if a voltage across the PN junction becomes relatively smaller, the input potential of the differential amplifier becomes lower. Since, however, the input voltage is shifted to a higher side by the source follower circuit, it is possible to adequately secure the operation margin even under a higher temperature condition. It is, therefore, possible to obtain an improved stability of the circuit operation even under a higher temperature condition.

Further, the PMOS transistors P8 and P9 are made smaller in size than other PMOS transistors and, therefore, the input capacity of the PMOS transistors P8 and P9 can be set to be smaller. It is also possible to reduce the parasitic capacitance of the negative feedback circuit and, hence, to adequately secure the phase margin and improve the stability of the circuit operation.

Figure 8:
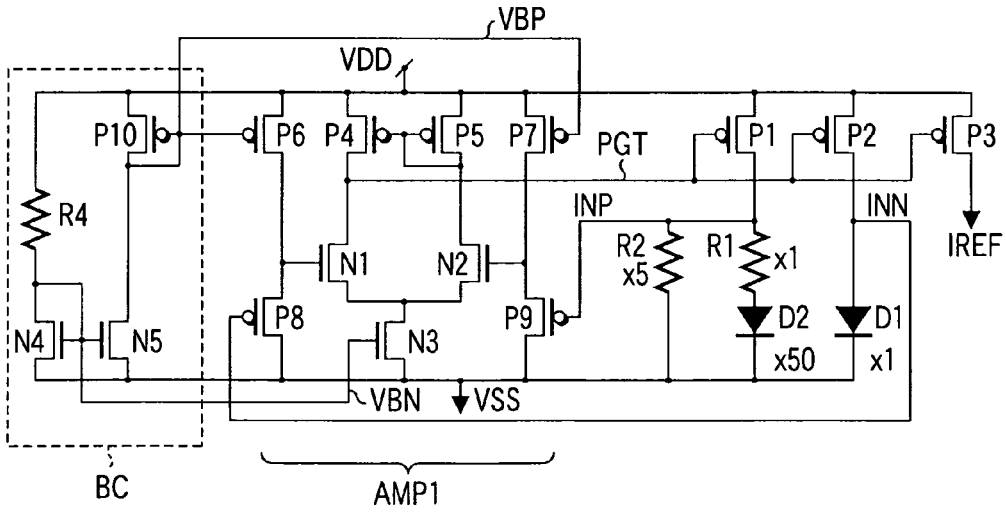
FIG. 8 shows a modification of the second embodiment, that is, a practical form of a reference current generation circuit.

FIG. 8 shows a modification of the second embodiment, that is, a practical form of a reference current generation circuit. The circuit shown in FIG. 8 is such that a resistor R3 is eliminated from the circuit shown in FIG. 6. In this circuit, a reference current IREF is outputted from the drain of a PMOS transistor P3.

The circuit, even if being so configured as shown in FIG. 8, can achieve the same advantages as those of the second embodiment.

Figure 9:
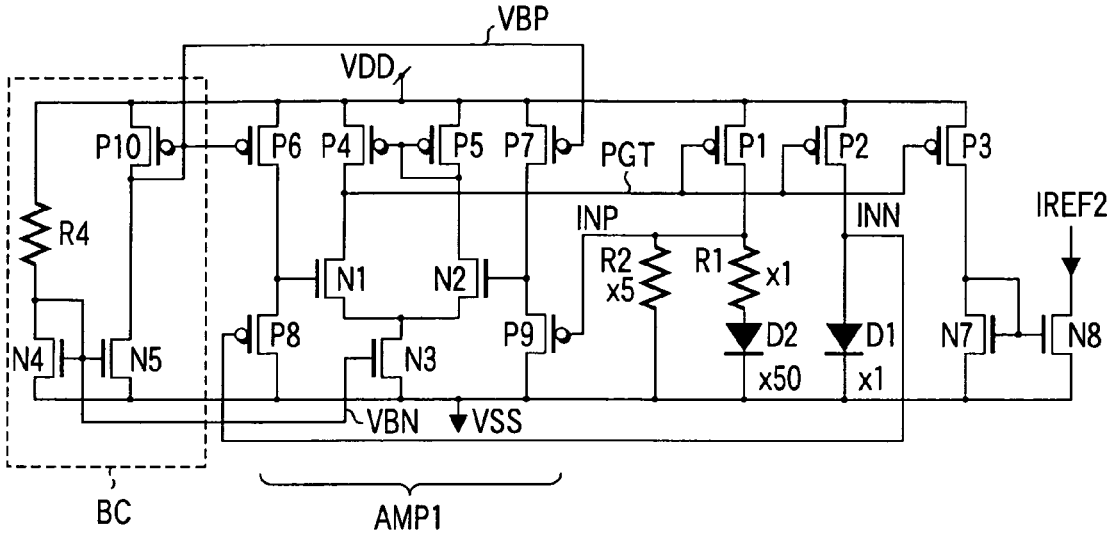
FIG. 9 shows a modification of a second embodiment, that is, a practical form of a reference current generation circuit.

FIG. 9 shows another modification of the second embodiment, that is, a practical form of a reference current generation circuit. NMOS transistors N7 and N8 constituting a current mirror circuit are connected to the drain of a PMOS transistor P3. That is, the drain and gate of the NMOS transistor N7 and gate of the NMOS transistor N8 are connected to the drain of the PMOS transistor P3. The sources of these NMOS transistors N7 and N8 are connected to a VSS node. From the drain of the NMOS transistor N8, a reference current IREF 2 is outputted.

According to the arrangement shown in FIG. 9 it is possible to provide a constant current supply of less variation against a temperature variation.

Figure 10:
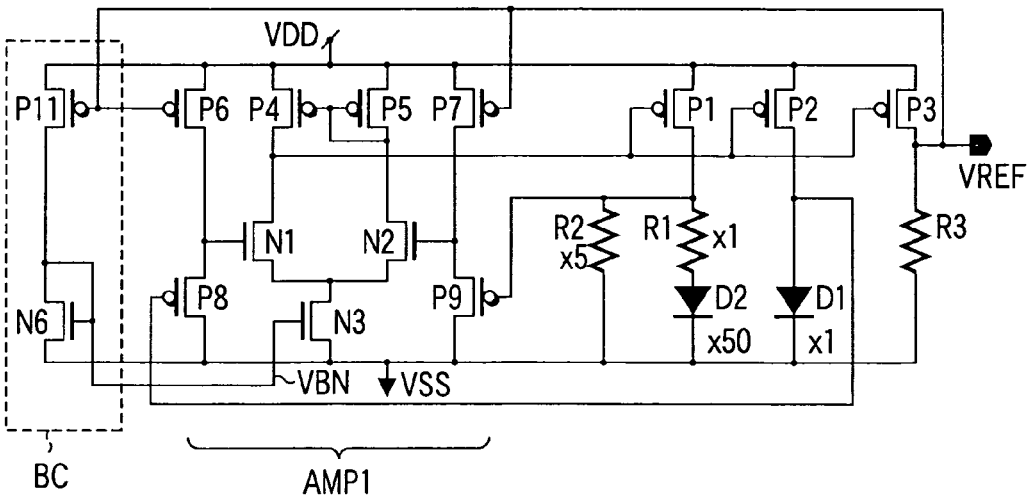
FIG. 10 shows a modification of the second embodiment, that is, a practical form of a reference voltage generation circuit.

FIG. 10 shows still another form of the second embodiment, that is, a practical form of a reference voltage generation circuit. In FIG. 10, a bias circuit BC comprises an NMOS transistor N6 and PMOS transistor P11. The PMOS transistor P11 has its source connected to a VDD node and its gate connected to an output node and the gates of PMOS transistors P6 and P7 are connected to the output node. The PMOS transistor P11 has its drain connected to the drain and gate of the NMOS transistor N6 and to the gate of the transistor N3. The source of the NMOS transistor N6 is connected to the VSS node.

According to the arrangement above, a resistor can be eliminated from the bias circuit BC and the bias circuit can be comprised of transistors only. It is, therefore, possible to reduce the size of the bias circuit BC.

Figure 11:
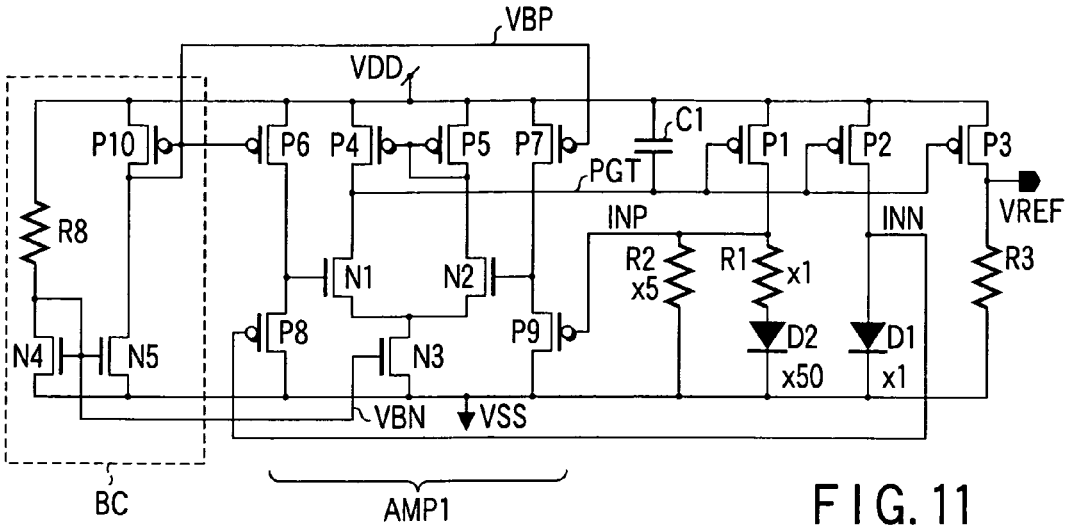
FIG. 11 shows a modification of the second embodiment, that is, a practical form of a reference voltage generation circuit.

FIG. 11 shows a further modification of a second embodiment, that is, a practical form of a reference voltage generation circuit. In FIG. 11, a capacitance Cl is connected, as a capacitive load, between a VDD node and an output end of a differential amplifier AMP1. The capacitance C1 compensates for the phase of a negative feedback circuit.

By connecting the capacitor C1 between the Vdd node and the output end of the differential amplifier AMP1 it is possible to improve a tolerance to a power supply noise. Further, PMOS transistors P8 and P9 as a source follower circuit involve less parasitic capacitance and it is possible to advantageously reduce the size of the capacitor C1.

Figure 12:
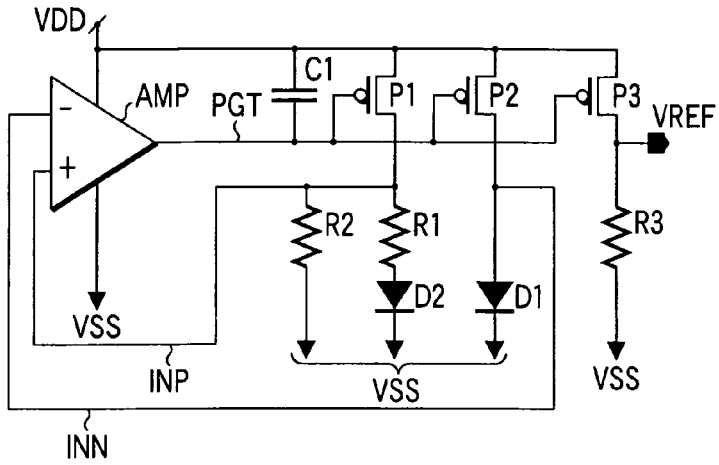
FIG. 12 is a circuit diagram showing a variant of FIG. 1.

FIG. 12 shows a modification of the embodiment of FIG. 1. In FIG. 12, a phase compensating capacitor is connected, as in the case of the modification shown in FIG. 11, between an output node of a differential amplifier and a VDD node. According to this arrangement, it is possible to improve the phase margin of the circuit shown in FIG. 1.

Figure 13:
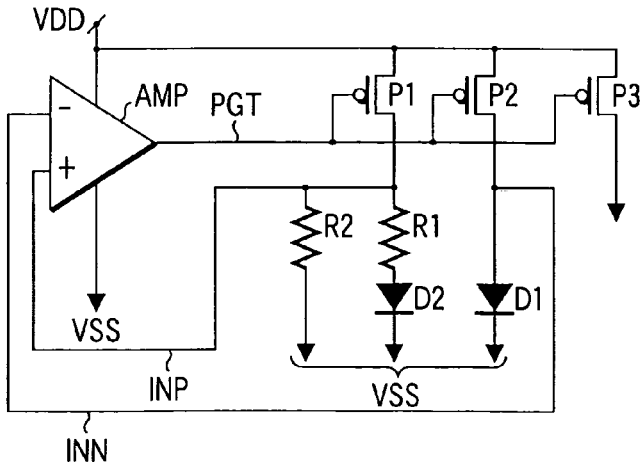
FIG. 13 shows a modification of the circuit shown in FIG. 1, that is, a reference current generation circuit.

FIG. 13 shows a modification of the circuit shown in FIG. 1, that is, a practical form of a reference current generation circuit where a resistor R3 is eliminated.

Figure 14:
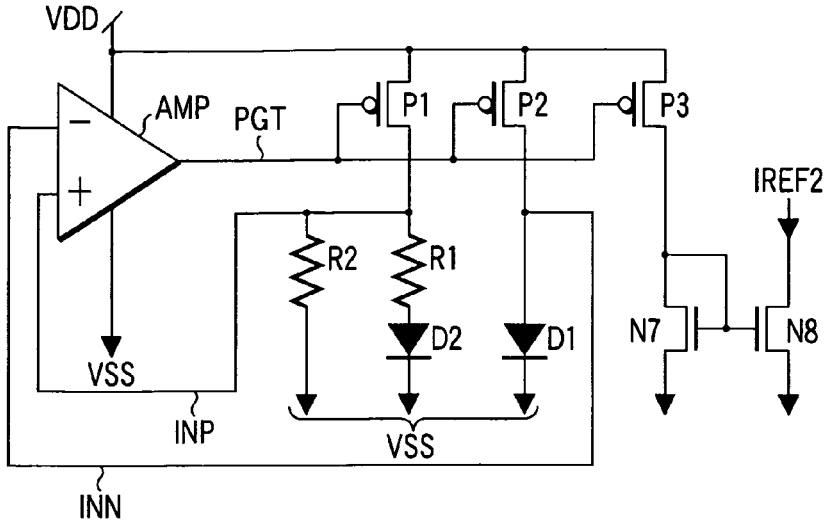
FIG. 14 shows a modification of the circuit shown in FIG. 1, that is, a reference current generation circuit.

FIG. 14 shows a modification of the circuit shown in FIG. 1, that is, a reference current generation circuit. The circuit shown in FIG. 14 is such that, in place of the resistor R3, a current mirror circuit is provided, the current mirror circuit comprising NMOS transistors N7 and N8 and a reference current IREF2 being outputted from the NMOS transistor N8.

Figure 15:
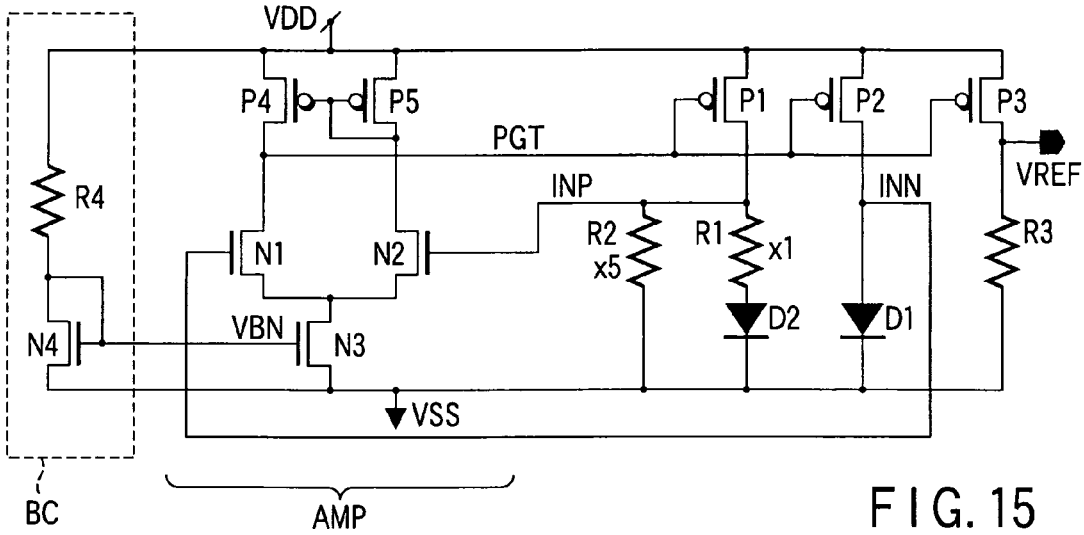
FIG. 15 shows a modification of the circuit shown in FIG. 1, that is, a practical form of a reference voltage generation circuit.

FIG. 15 shows another modification of the circuit shown in FIG. 1, that is, a practical circuit form with a bias circuit BC. The bias circuit BC comprises a resistor R4 and NMOS transistor N4. The resistor R4 has one end connected to a VDD node and the other end connected to the drain and gate of the NMOS transistor N4. The gate of the NMOS transistor N4 serving as an output end of the bias circuit BC is connected to the gate of the above-mentioned NMOS transistor N3 in the differential amplifier AMP. Thus, the differential amplifier AMP is biased by the bias circuit BC.

(Third Embodiment)

Figure 16:
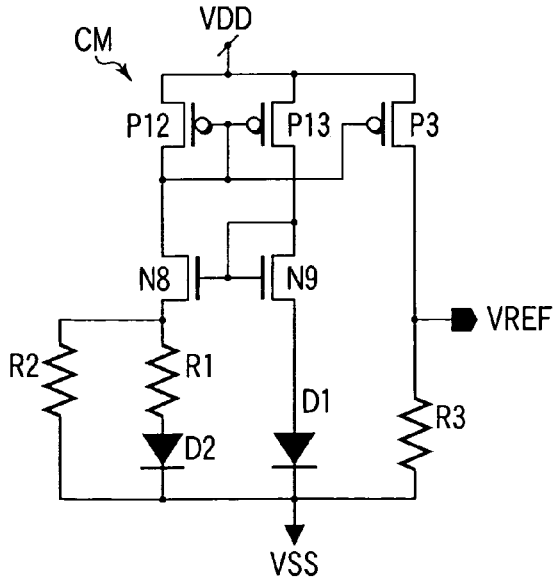
FIG. 16 shows a third embodiment, that is, a practical form of a reference voltage generation circuit.

FIG. 16 shows a third embodiment, that is, a practical form of a reference voltage generation circuit. In the third embodiment, a current mirror circuit CM is used in place of the differential amplifier. That is, in FIG. 16, a current mirror circuit CM comprises PMOS transistors P12, P13 and NMOS transistors N8, N9. To the VDD node, the sources of the PMOS transistors P12 and P13 are connected. The PMOS transistor P12 has its gate connected to the gate of the PMOS transistor P13 and its drain connected to the gate of the PMOS transistor P3. The drains of the PMOS transistors P12 and P13 are connected to the drains of the NMOS transistors N8 and N9. The NMOS transistor N8 has its gate connected to the gate of the NMOS transistor N9 and to the drain of the NMOS transistor N9. A diode D1 is connected between the source of the NMOS transistor N9 and a VSS node. A series circuit of a resistor R1 and diode D2 and a resistor R2 are connected between the source of the NMOS transistor N8 and the VSS node. The size relation of the diodes D1 and D2 is as in the case of the first embodiment and the size of the diode D2 is set to be, for example, 50 times that of the diode D1.

The PMOS transistor P3 and resistor R3 are series connected between the VDD node and the VSS node. The gate of the PMOS transistor P3 is connected to the drain of the NMOS transistor N8. A reference voltage VREF is outputted from a connection node between the PMOS transistor P3 and a resistor R3.

In this arrangement, a current through the diode D1 is copied by the NMOS transistor N9 to the NMOS transistor N8 and the PMOS transistors P13 and P3 are controlled in accordance with a current flowing through the NMOS transistor N8. For this reason, the same current flows through the transistors N8, N9 and P3 and, in accordance with the current, a reference voltage VREF is outputted from the connection node of the resistor R3.

According to the arrangement above, the size of the diodes D1, D2 is the same as in the first embodiment and a resistor is not connected in parallel with the diode D1. Therefore, it is possible to reduce the size of the circuit and ensure a stable operation.

A current mirror circuit CM constituted by the NMOS transistors N8, N9 and PMOS transistors P12, P13 has no voltage gain. It is, therefore, not necessary to consider the oscillation of the circuit and, thus, to ensure phase compensation with the resultant advantage.

It is to be noted that if, in FIG. 16, the resistor R3 is eliminated, then it is possible to provide a reference current generation circuit.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. A reference power supply circuit comprising:

a first PN junction configured to connect an N type semiconductor area to a first potential;

a second PN junction configured to connect an N type semiconductor area to the first potential and having a size different from that of the first PN junction;

a first current supply configured to be connected between a second potential and a P type semiconductor area of the first PN junction, the first current supply supplying a current only to the first PN junction;

a first resistive element configured to have one end connected to a P type semiconductor area of the second PN junction;

a second resistive element configured to be connected in parallel with the first resistive element and second PN junction;

a second current supply configured to be inserted between the other end of the first resistive element and the second potential;

a third current supply configured to be connected between the second potential and an output terminal; and a differential amplifier configured to have an inverting input terminal and a non-inverting input terminal and to receive, at the inverting input terminal, a potential on a first connection point between the first current supply and the first PN junction and, at the non-inverting input terminal, a potential on a second connection point between the second current supply and the first resistive element and to control the first, second and third current supplies by a difference between a potential of the inverting input terminal and a potential of the non-inverting input terminal.

2. A circuit according to claim 1, wherein the differential amplifier has a source follower circuit configured to receive potentials on the first and second connection points.

3. A circuit according to claim 1, wherein the size of the second PN junction is greater than that of the first PN junction.

4. A circuit according to claim 1, wherein the resistive value of the second resistive element is greater than that of the first resistive element.

5. A circuit according to claim 1, further comprising a third resistive element configured to be connected between the output terminal and the first potential, the output terminal outputting a reference voltage.

6. A circuit according to claim 1, further comprising a current mirror circuit configured to be connected between the third current supply and the first potential and to output a reference current.

7. A circuit according to claim 2, further comprising a bias circuit configured to be controlled by a voltage on the output terminal and to apply a bias potential to the differential amplifier.

8. A circuit according to claim 2, further comprising a capacitive load configured to be connected between an output terminal of the differential amplifier and the second potential.

9. A reference power supply circuit comprising:

a first diode having a cathode connected to a first potential;

a second diode having a cathode connected to the first potential and having a size different from that of the first diode;

a first transistor of a first conductivity type configured to be connected between a second potential and the anode of the first diode, the first transistor supplying a current only to the first diode;

a first resistive element having one end connected to the anode of the second diode;

a second resistive element configured to be connected in parallel with the first resistive element and second diode;

a second transistor of a first conductivity type configured to be inserted between the other end of the first resistive element and the second potential and constitute a current supply;

a third transistor of a first conductivity type configured to be connected between the second potential and an output terminal and constitute a current supply; and a source follower differential amplifier having an inverting input terminal and a non-inverting input terminal and configured to receive, at the inverting input terminal, a potential on a first connection point between the first transistor and the first diode and, at the non-inverting input terminal, a potential on a connection point between the second transistor and the first resistive element, the source follower differential amplifier being configured to control the first, second and third transistors by a difference between a potential of the inverting input terminal and a potential of the non-inverting input terminal.

10. A circuit according to claim 9, wherein the source follower differential amplifier comprises:

a fourth transistor of a first conductivity type having a current path with one end connected to the first potential and a gate connected to the first connection point;

a fifth transistor of a first conductivity type having a current path with one end connected to the first potential and a gate connected to the second connection point;

a sixth transistor of a first conductivity type having a current path with one end connected to the other end of the current path of the fourth transistor and with the other end connected to the second potential, the gate of the sixth transistor being connected to a first output terminal of the bias circuit;

a seventh transistor of a first conductivity type having a current path with one end connected to the other end of the current path of the fifth transistor and with the other end connected to the second potential, the gate of the seventh transistor being connected to the first output terminal of the bias circuit;

an eighth transistor of a second conductivity type having a current path with one end connected to the first potential and a gate connected to a second output terminal of the bias circuit;

a ninth transistor having a current path with one end connected to the other end of the current path of the eighth transistor and a gate connected to the other end of the current path of the eighth transistor;

a tenth transistor of a second conductivity type having a current path with one end connected to the other end of the current path of the eighth transistor and a gate connected to the other end of the current path of the fifth transistor;

an eleventh transistor of a first conductivity type having a current path with one end connected to the other end of the current path of the ninth transistor and said output end and with the other end connected to the second potential; and a twelfth transistor of a first conductivity type having a current path with one end connected to the other end of the current path of the tenth transistor and with the other end connected to the second potential, the gate of the twelfth transistor being connected to the gate of the eleventh transistor and to the other end of the current path of the tenth transistor.

11. A circuit according to claim 9, wherein the size of the second diode is greater than that of the first diode.

12. A circuit according to claim 9, wherein the resistive value of the second resistive element is greater than that of the first resistive element.

13. A circuit according to claim 9, further comprising a third resistive element connected between said output terminal and the first potential, said output terminal outputting a reference voltage.

14. A circuit according to claim 9, further comprising a current mirror circuit connected between said third current supply and the first potential and configured to output a reference current.

15. A circuit according to claim 9, wherein said bias circuit comprises a thirteenth transistor of a second conductivity type and fourteenth transistor of a first conductivity type configured to be series-connected between the first potential and the second potential and the gate of the fourteenth transistor being connected to a connection point between the thirteenth transistor and the fourteenth transistor and constituting said output terminal;

a fifteenth transistor of a second conductivity type having a current path with one end connected to the first potential, the gate of the fifteenth transistor being connected to the gate of the thirteenth transistor and to the other end of the current path of the fifteenth transistor and constituting said second output terminal; and a fourth resistive element having one end connected to the other end of the current path of the fifteenth transistor and the other end connected to the second potential.

16. A circuit according to claim 15, wherein said bias circuit comprising a sixteenth transistor of a second conductivity type and seventeenth transistor of a first conductivity type configured to be series-connected between the first potential and the second potential, the gate of the seventeenth transistor being connected to said output terminal of the differential amplifier and constituting said first output terminal and the gate of the sixteenth transistor being connected to a connection point between the sixteenth transistor and the seventeenth transistor and constituting said output terminal.

17. A circuit according to claim 10, further comprising a capacitive load connected between an output terminal of the differential amplifier and the second potential.

18. A reference power supply circuit comprising:

a first PN junction configured to connect an N type semiconductor area to a first potential;

a second PN junction configured to connect an N type semiconductor area to the first potential and having a size different from that of the first PN junction;

a first resistive element having one end connected to a P type semiconductor area of the second PN junction;

a second resistive element configured to be connected in parallel with the first resistive element and said second PN junction;

a current supply connected between a second potential and an output terminal the current supply having a control gate; and a mirror circuit having first, second, third and fourth nodes, the first node being connected to a P type semiconductor area of the first PN junction, the second node being connected to another end of the first resistive element, the third node being connected to the control gate of the current supply and the fourth node being connected to the second potential, said mirror circuit configured to allow a current which flows through the first PN junction to be copied to a corresponding current through the first and second resistive elements and second PN junction and to control the current supply in accordance with the current through the first and second resistive elements and second PN junction.

19. A circuit according to claim 18, wherein the size of the second PN junction is greater than that of the first junction.

20. A circuit according to claim 18, wherein the resistive value of the second resistive element is greater than that of the first resistive element.

21. A circuit according to claim 18, wherein the mirror circuit comprises:

a first transistor has a first gate and a first current path, one end of the first current path is connected to a first node, the first transistor supplies a current only to the first PN junction; and a second transistor has a second gate and a second current path, the second gate is connected to the first gate of the first transistor and another end of the first current path of the first transistor, and one end of the second current path is connected to the second node and another end of the second current path is connected to the third node.

* * * * *